US007150635B2

(12) United States Patent
Ostmoe et al.

(10) Patent No.: US 7,150,635 B2
(45) Date of Patent: Dec. 19, 2006

(54) ELECTRICAL DEVICE HAVING AN ELECTRICAL COMPONENT SAFETY APPARATUS

(75) Inventors: Elin Ostmoe, Krakeroy (NO); Johnny Andre Lund, Krakeroy (NO)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 11/081,333

(22) Filed: Mar. 15, 2005

(65) Prior Publication Data

US 2006/0211284 A1 Sep. 21, 2006

(51) Int. Cl.
*H01R 13/44* (2006.01)

(52) U.S. Cl. ..... 439/135

(58) Field of Classification Search ..... 439/135, 439/468, 473, 501, 638–640, 449, 440, 133; 174/66–67

See application file for complete search history.

(56) References Cited

U.S. PATENT DOCUMENTS

| | | | | |
|---|---|---|---|---|
| 5,124,506 | A * | 6/1992 | Briggs et al. | 174/67 |
| 6,369,321 | B1 * | 4/2002 | Flegel | 174/50 |
| 6,406,327 | B1 * | 6/2002 | Soon | 439/501 |
| 6,913,395 | B1 * | 7/2005 | Watanabe et al. | 385/78 |
| 2002/0064981 | A1 * | 5/2002 | Yu et al. | 439/135 |
| 2005/0007556 | A1 * | 1/2005 | Yanagisawa | 353/31 |

* cited by examiner

*Primary Examiner*—J. F. Duverne
(74) *Attorney, Agent, or Firm*—Alleman Hall McCoy Russell & Tuttle LLP

(57) ABSTRACT

An electrical device having an electrical component safety apparatus is disclosed, wherein the electrical device includes a power connection configured to operatively engage a power cord, and an access door providing access to an electrical or electronic component, wherein the access door has a closed position and an open position. The access door is configured such that the door is prevented from transitioning between the closed position and the open position while the power cord is operatively engaged with the power connection.

26 Claims, 5 Drawing Sheets

ELECTRICAL DEVICE HAVING AN ELECTRICAL COMPONENT SAFETY APPARATUS

TECHNICAL FIELD

The present disclosure relates to electrical devices, and more particularly to electrical devices incorporating a safety apparatus for electrical components. Although the disclosure is entitled "electrical device having an electrical component safety apparatus," it is within the scope of the disclosure for the safety apparatus to be used with electrical or electronic devices and/or components.

SUMMARY

An electrical device having an electrical component safety apparatus is provided, wherein the electrical device includes a power connection configured to operatively engage a power cord, and an access door providing access to an electrical or electronic component, wherein the access door has a closed position and an open position. The access door is configured such that the door is prevented from transitioning between the closed position and the open position while the power cord is operatively engaged with the power connection.

BRIEF DESCRIPTION OF DRAWINGS

The disclosure is illustrated by way of example and not by way of limitation in the figures of the accompanying drawings, in which the like references indicate similar elements and in which.

DETAILED DESCRIPTION OF THE DEPICTED EMBODIMENTS

Figure 1:
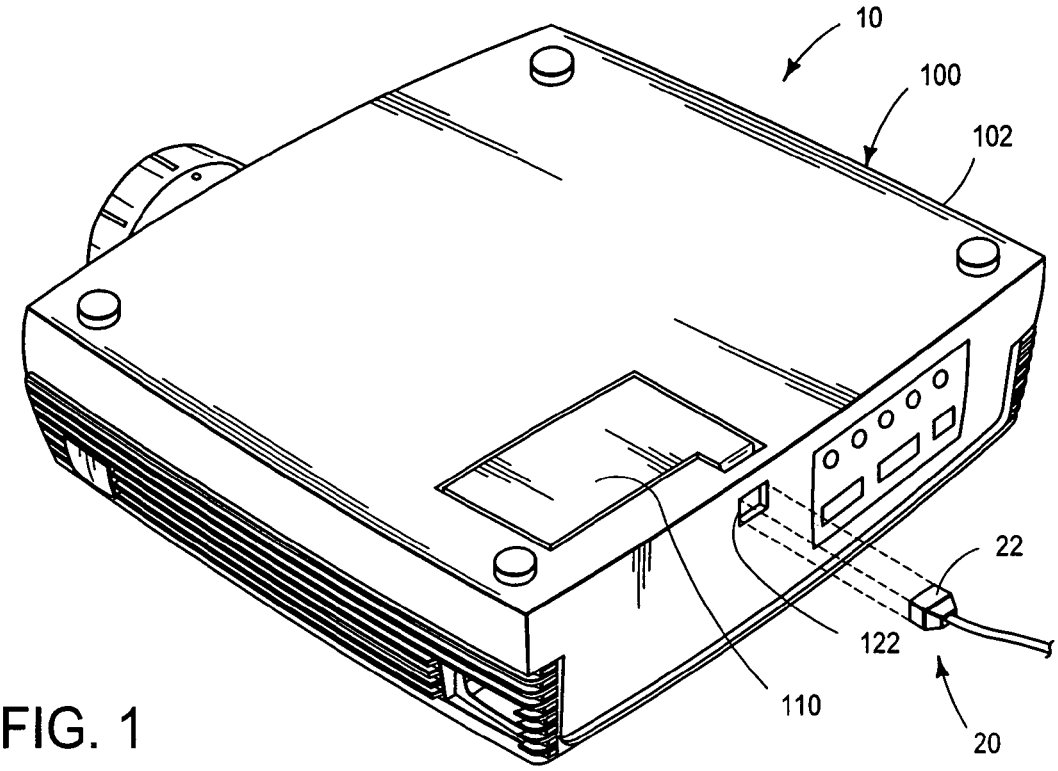
FIG. 1 is a perspective view of the underside of an exemplary image display device incorporating an embodiment of an electrical component safety apparatus of the present disclosure.

An illustrative example of a device incorporating an embodiment of an electrical component safety apparatus according to the present disclosure is shown generally at 10 in FIG. 1. The electrical component safety apparatus may be incorporated into any suitable electrical or electronic device where a user may wish to gain access but for where it may be preferable to prevent access while the electrical or electronic device is powered. An exemplary suitable device is one where it may be desirable to have user replaceable electrical or electronic components such as a lamp or any other electrical or electronic component that might need to be removed, inspected, maintained, replaced, or otherwise handled. Due to the possibility that various risks such as hazardous voltages, currents, radiation, temperatures, or moving parts might be present in such an electrical or electronic device or component, it may be desirable to prevent user access to the components when the device or components thereof are energized. A further exemplary device is one in which it might be desirable to prevent user alteration of control settings while the device is powered. Therefore, while the discussion herein is directed toward image display devices, it will be appreciated by one of ordinary skill in the art that the discussion may apply to any other suitable electrical or electronic device.

As will be discussed in accordance with FIGS. 1–3, an embodiment of the electrical component safety apparatus 10 of the present disclosure is shown as being incorporated into projector 100.

As illustrated in FIG. 1, projector 100 may include a housing 102 and an access door 110 disposed on the housing. Access door 110 may take various forms, such as a removable access panel, a hinged access door or panel, or a lamp door. Further, access door 110 may be disposed on any surface or combination of surfaces of housing 102. In projector 100, access door 110 may be used to provide access to electrical or electronic components, such as a lamp, light source, and/or image generation device, disposed within the interior of an electrical or electronic device. In some embodiments, access door 110 may be used to restrict access to concealed controls. Further, in some embodiments, access door 110 may also include an electrical component such that access door 110 and an electrical component may form a modular unit permitting easy access or removal for tasks that may include inspection, maintenance, or replacement.

Projector 100 may also include a removable power cord 20 having a connector such as plug 22 at one end. An opposite end of power cord 20 may be connected to some external power supply such as a transformer, battery, or an AC wall socket. Power cord 20 may be connected to projector 100 by inserting plug 22 through power connection opening 122 into housing 102.

Figure 2A:
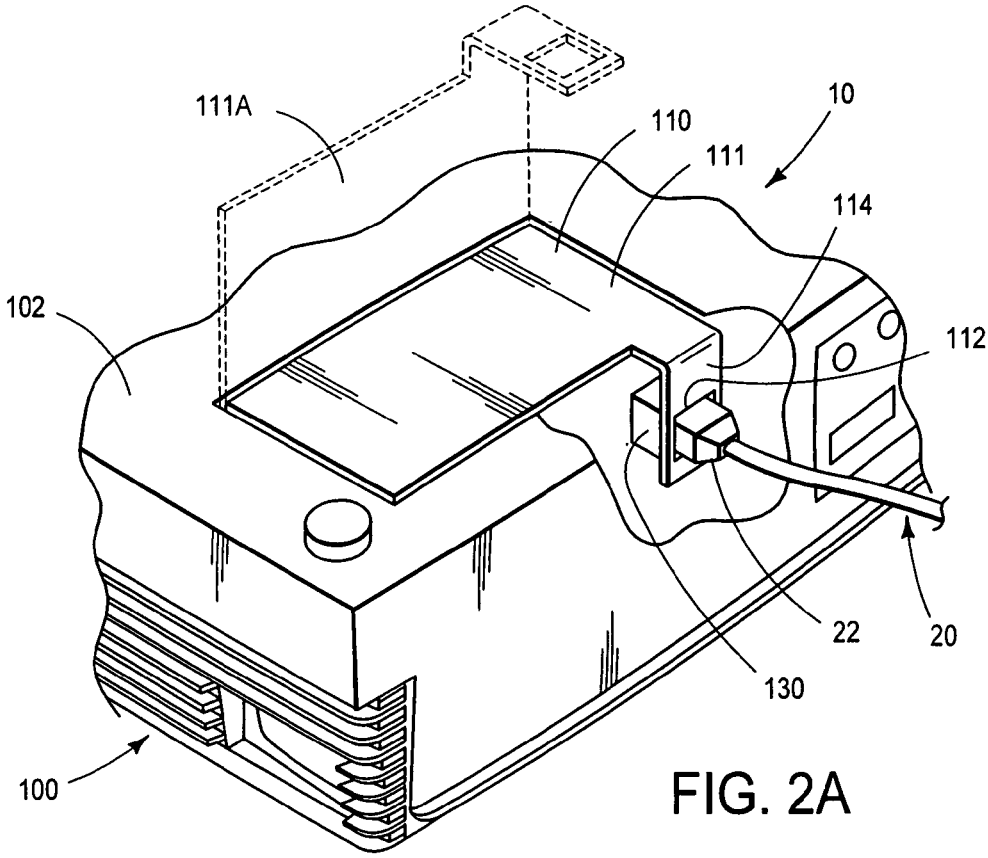
FIG. 2A is a fragmentary perspective view of the embodiment of FIG. 1 with a lamp door shown in open and closed positions and with a power cord connected to the projection device.

As illustrated in FIG. 2A, access door 110 may be positioned in closed position 111 or open position 111A, where open position 111A may be understood to include any and all positions of door 110 other than closed position 111.

Door 110 may pivot from closed position 111 to open position 111A as when door 110 is hingedly coupled to housing 102. However, in some embodiments, door 110 may transition from closed position 111 to an open position in other manners such as vertical, rotational, and/or horizontal translation.

Power cord 20 may be connected to projector 100 by operatively engaging a portion of power cord 20 such as plug 22 with a power connection 130, which may be disposed on or within housing 102. Operative engagement between power cord 20 and power connection 130 may exist when power is capable of passing from power cord 20 to projector 100 through power connection 130. In some embodiments, power connection 130 may be a power inlet socket configured to receive plug 22. Power connection 130 and plug 22 may each be one of a corresponding pair of male and female type connectors. In other embodiments, power connection 130 and plug 22 may be other types of connectors, so long as the selected power connection 130 and plug 22 are both mutually configured to allow creation of an operative engagement between them.

In some embodiments, door 110 may include an opening 112 configured such that a portion of power cord 20 or plug 22 may be at least partially disposed within opening 112 when power cord 20 is operatively engaged with power connection 130. Opening 112 may be an orifice or an aperture such that at least a portion of door 110 uninterruptedly surrounds opening 112 on all sides. In other embodiments, opening 112 may intersect an edge of door 110 such that opening 112 may have one or more open sides.

In some embodiments, door 110 may include an arm 114 extending therefrom. Arm 114 may extend from an edge of door 110 as shown in FIG. 2A and may additionally include one or more bends such that at least a portion of arm 114 may be either not coplanar with or not parallel to at least a portion of door 110. When door 110 includes arm 114 and opening 112, opening 112 may be at least partially located in arm 114. In embodiments where opening 112 is at least partially through arm 114, opening 112 may be an aperture, or opening 112 may intersect an edge of door 110 or arm 114 such that opening 112 may have one or more open sides.

In embodiments where door 110 includes arm 114 and opening 112, as shown in FIG. 2A, operative alignment between opening 112 and power connection 130 may be prevented when door 110 is not fully in closed position 111. Likewise, operative alignment of opening 112 and power connection 130 may permit power cord 20 to be operatively engaged with power connection 130. In some embodiments, operative alignment of opening 112 and power connection 130 may make it possible to dispose a portion of power cord 20 through opening 112 to enable operative engagement of power cord 20 with power connection 130.

Figure 2B:
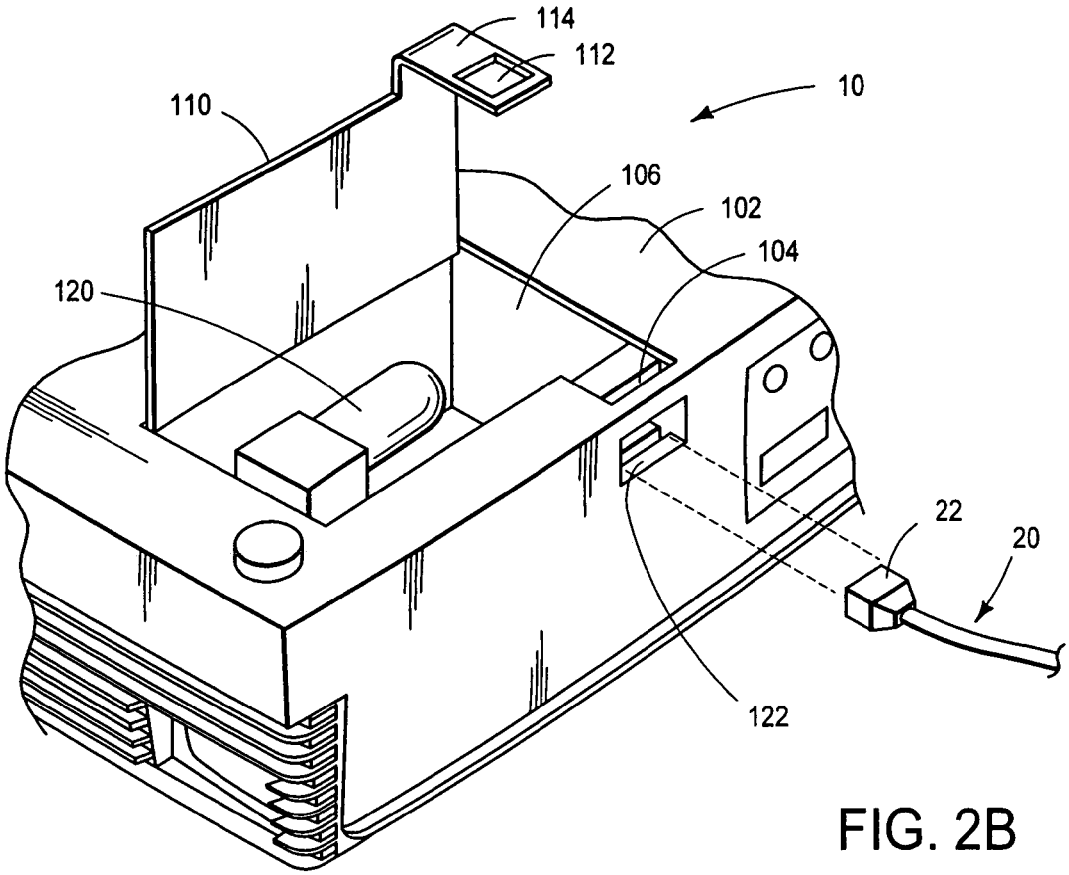
FIG. 2B is a fragmentary perspective view of the embodiment of FIG. 1 with the lamp door shown in the open position and with the power cord disconnected.

As illustrated in FIG. 2B, access door 110 may provide access to an electrical or electronic component within housing 102, such as a light source or projector lamp 120, in which case access door 110 may be considered a "lamp door." When access door 110 is in open position 111A, a user may access projector lamp 120 through access opening 106. In some embodiments, access door 110 may permit access to various types of electrical or electronic components and/or controls that may be disposed within housing 102.

In some embodiments, an opening 104 may be disposed on housing 102, with opening 104 being generally proximate to access opening 106. Projector 100 may be configured such that opening 104 extends through, and/or intersects with, power connection opening 122. Further, opening 104 and arm 114 may then be mutually configured such that arm 114 may be disposed within opening 104 when access door 110 is in closed position 111, in which case arm 114 may be at least partially disposed within power connection opening 122.

Figure 3:
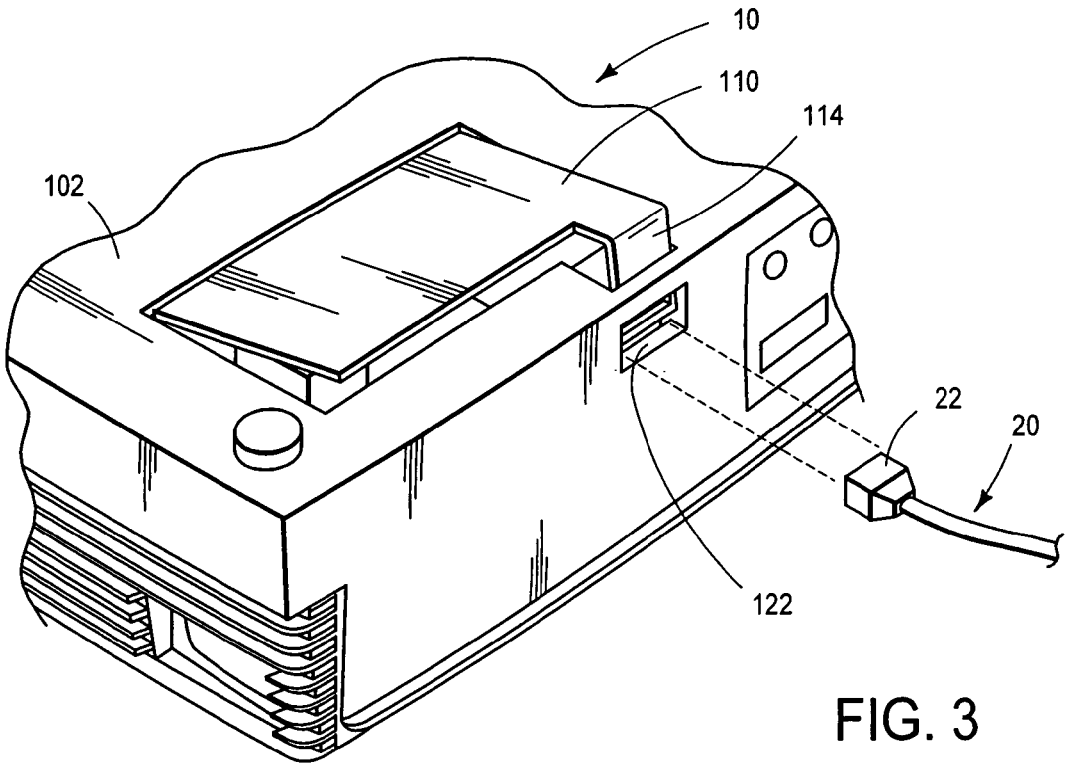
FIG. 3 is a fragmentary perspective view of the embodiment of FIG. 1 with the lamp door shown in a partially open position and with the power cord disengaged.

FIG. 3 illustrates projector 100 with access door 110 shown in a partially open position. When access door 110 of projector 100 is not in closed position 111, such as when door 110 is partly open, arm 114 may be partly disposed within opening 104 and a portion of arm 114 other than opening 112 may be at least partly disposed within power connection opening 122. Further, partly disposing arm 114 within power connection opening 122 may effectively prevent operative engagement of power cord 20 with power connection 130. In such an embodiment, operative engagement of power cord 20 with power connection 130 may be prevented because arm 114 may effectively prevent insertion of power cord 20 or plug 22 sufficiently far enough into power connection opening 122 to establish an operative engagement between power cord 20 and power connection 130. Thus, in these embodiments, it may be necessary to transition access door 110 to fully closed position 111 prior to operatively engaging power cord 20 with power connection 130.

In some embodiments of projector 100, projector 100 may include an interlock configured such that projector lamp 120 or other electrical or electronic components contained within housing 102 may be rendered inoperable when access door 110 is in other than fully closed position 111. In some embodiments, such an interlock may comprise an electrical interrupt configured to disconnect power from the electrical or electronic components contained within housing 102 when access door 110 is in other than fully closed position 111. In some embodiments, such an interlock may take the form of a mechanical barrier interposed within or across power connection opening 122 when access door 110 is in other than fully closed position 111. Such a mechanical barrier may be configured such that transitioning access door 110 to a fully closed position 111 may effect the removal of the mechanical barrier from power connection opening 122. When the mechanical barrier is removed from power connection opening 122, power cord 20 may be operatively engaged with power connection 130. In some embodiments, such a mechanical barrier may comprise a spring-actuated sliding plastic shield that covers opening 122 until transitioning access door 110 to a fully closed position 111 removes the plastic shield from opening 122.

Although various embodiments of projector 100 may be configured such that door 110 closes by pivoting, as shown in FIG. 3, or by rotational, vertical, and/or horizontal translation, arm 114 and opening 104 may be mutually configured in any of these embodiments such that arm 114 will extend into opening 104 and intersect power connection opening 122.

In some embodiments of the electrical component safety apparatus 10, as illustrated in FIGS. 1–3, operative engagement of power cord 20 with power connection 130 may preclude transition of door 110 from closed position 111 to open position 111A because power cord 20 may be disposed within both power connection opening 122 and opening 112 due to the operative engagement. Thus, in such an embodiment, operative engagement of power cord 20 with projector 100 may have the effect of locking or securing door 110 in closed position 111. In these embodiments, prior to opening access door 110, it may be necessary to disconnect power cord 20 from projector 100 such that power cord 20 is no longer disposed within opening 112 in door 110 and no longer operatively engaged with power connection 130.

Such a situation may have the effect of removing power input from projector 100 prior to opening access door 110.

As will be discussed in accordance with FIGS. 4A–4C, another embodiment of the electrical component safety apparatus 12 of the present disclosure is shown as being incorporated into projector 200.

Figure 4A:
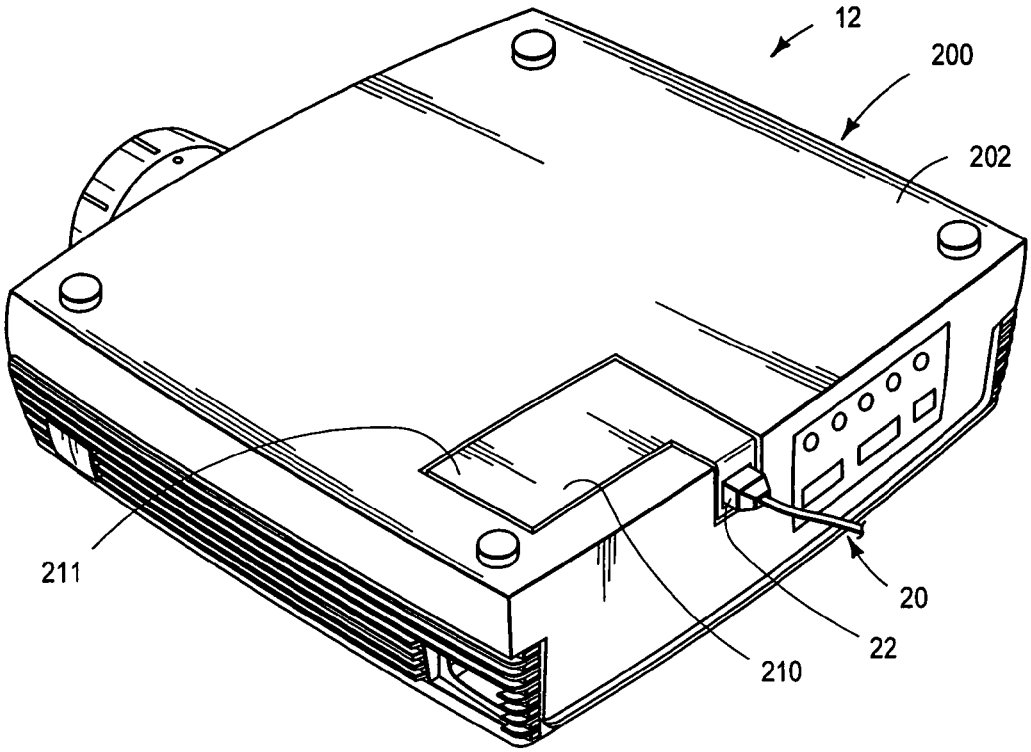
FIG. 4A is a perspective view of the underside of an exemplary projection device incorporating another embodiment of an electrical component safety apparatus of the present disclosure.

As illustrated in FIG. 4A, projector 200 may include a housing 202 and an access door 210 disposed on the housing. Access door 210 may take various forms, such as a removable access panel, a hinged access door or panel, or a lamp door. Further, access door 210 may be disposed on any surface or combination of surfaces of housing 202. In projector 200, access door 210 may be used to provide access to electrical or electronic components, such as a lamp, light source, and/or image generation device, disposed within the interior of an electrical or electronic device. In some embodiments, access door 210 may be used to restrict access to concealed controls. In some embodiments, access door 210 may also include an electrical component such that access door 210 may form a modular unit with an electrical component permitting easy access or removal for tasks that may include inspection, maintenance, or replacement. FIG. 4A illustrates access door 210 positioned in an operative closed position 211.

Projector 200 may also include a removable power cord 20 having a connector such as plug 22 at one end. An opposite end of power cord 20 may be connected to some external power supply such as a transformer, battery, or an AC wall socket.

Figure 4B:
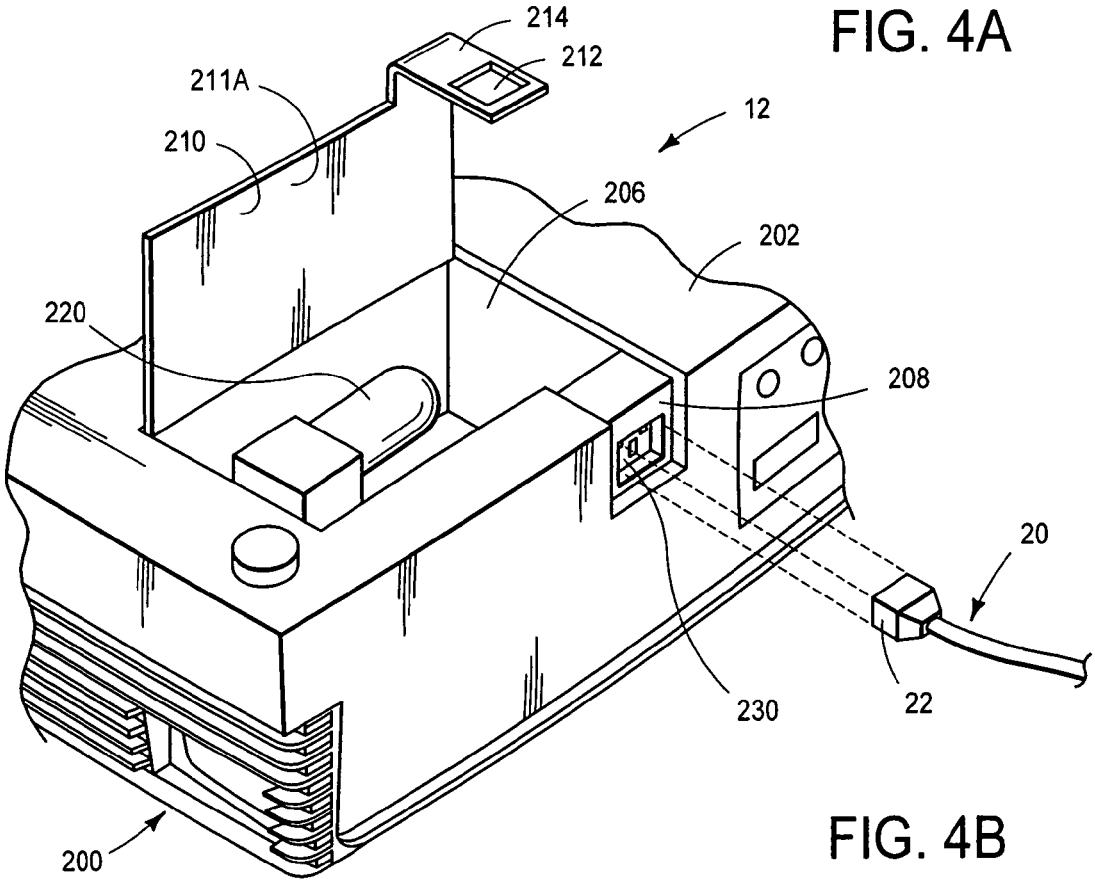
FIG. 4B is a fragmentary perspective view of the embodiment of FIG. 4A showing the lamp door in an open position and the power cord disconnected.

As illustrated in FIG. 4B, access door 210 may be positioned in an open position 211A, where open position 211A may be understood to include any and all positions of door 210 other than closed position 211. Door 210 may pivot from closed position 211 to open position 211A as when door 210 is hingedly coupled to housing 202. However, in some embodiments, door 210 may transition from closed position 211 to an open position in manners such as vertical, rotational, and/or horizontal translation.

Access door 210 may provide access to an electrical or electronic component within housing 202, such as a light source or projector lamp 220, in which case access door 210 may be considered a "lamp door." When access door 210 is in open position 211A, a user may access projector lamp 220 through access opening 206. In some embodiments, access door 210 may permit access to various types of electrical or electronic components and/or controls that may be disposed within housing 202.

Power cord 20 may be connected to projector 200 by operatively engaging a portion of power cord 20 such as plug 22 with a power connection 230, which may be disposed on or within housing 202. Operative engagement between power cord 20 and power connection 230 may exist when power is capable of passing from power cord 20 to projector 200 through power connection 230. In some embodiments, power connection 230 may be a power inlet socket configured to receive plug 22. Power connection 230 and plug 22 may each be one of a corresponding pair of male and female type connectors. In other embodiments, power connection 230 and plug 22 may be other types of connectors, so long as the selected power connection 230 and plug 22 are both mutually configured to allow creation of an operative engagement between them.

In some embodiments, door 210 may include an opening 212 configured such that a portion of power cord 20 or plug 22 may be at least partially disposed within opening 212 when power cord 20 is operatively engaged with power connection 230. Opening 212 may be an orifice or an aperture such that at least a portion of door 210 uninterruptedly surrounds opening 212 on all sides. In other embodiments, opening 212 may intersect an edge of door 210 such that opening 212 may have one or more open sides.

In some embodiments, door 210 may include an arm 214 extending therefrom. Arm 214 may extend from an edge of door 210 as shown in FIG. 4B and may additionally include one or more bends such that at least a portion of arm 214 may be either not coplanar with or not parallel to at least a portion of door 210. When door 210 includes both arm 214 and opening 212, opening 212 may be at least partially located in arm 214. In embodiments where opening 212 is at least partially through arm 214, opening 212 may be an aperture, or opening 212 may intersect an edge of door 210 or arm 214 such that opening 212 may have one or more open sides.

Projector 200 may be configured such that arm 214 is disposed generally externally to housing 202 when door 210 is in closed position 211, as shown in FIGS. 4A–4B. However, housing 202 may be further configured such that arm 214 may be flush with one or more sides of housing 202 when door 210 is in closed position 211. Such a flush disposition of arm 214 may be obtained through provision of cutout 208 in housing 202 in which arm 214 may be disposed when door 210 is in closed position 211.

Figure 4C:
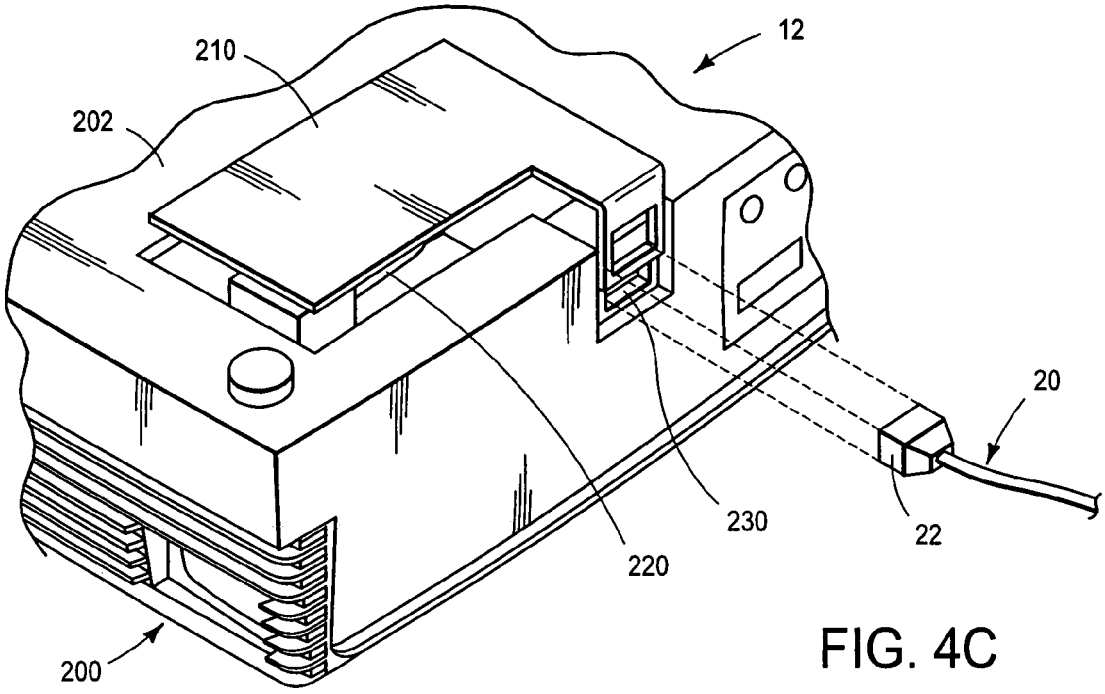
FIG. 4C is a fragmentary perspective view of the embodiment of FIG. 4A showing an alternate embodiment of the lamp door.

In embodiments where door 210 includes arm 214 and opening 212, as shown in FIG. 4C, operative alignment between opening 212 and power connection 230 may be prevented when door 210 is not fully in closed position 211. Likewise, operative alignment of opening 212 and power connection 230 may permit power cord 20 to be operatively engaged with power connection 230. In some embodiments, operative alignment of opening 212 and power connection 230 may make it possible to dispose a portion of power cord 20 through opening 212 to enable operative engagement of power cord 20 with power connection 230.

FIG. 4C illustrates projector 200 with access door 210 shown in a partially open condition. When access door 210 of projector 200 is not in closed position 211, such as when door 210 is partly open, arm 214 may partially block power connection 230 and effectively prevent insertion of power cord 20 or plug 22 into power connection 230. Such partial blockage of power connection 230 may effectively prevent operative engagement of power cord 20 with power connection 230. Thus, in these embodiments, it may be necessary to transition access door 210 to fully closed position 211 prior to operatively engaging power cord 20 with power connection 230.

In some embodiments of projector 200, projector 200 may include an interlock configured such that projector lamp 220 or other electrical or electronic components contained within housing 202 may be rendered inoperable when access door 210 is other than in fully closed position 211. In some embodiments, such an interlock may take the form of a mechanical barrier within or across power connection 230, wherein transitioning access door 210 to a fully closed position 211 may effect removal of the mechanical barrier from power connection 230. When the mechanical barrier is removed from power connection 230, power cord 20 may be operatively engaged with power connection 230. Further exemplary interlocks include, but are not limited to, those discussed above for projector 100.

Although various embodiments of projector 200 may be configured such that door 210 closes by vertical translation, as shown in FIG. 4C, projector 200 may also be configured such that door 210 closes by horizontal translation and/or hinged rotation.

In some embodiments of the electrical component safety apparatus 12, as illustrated in FIGS. 4A–4C, operative engagement of power cord 20 with power connection 230 may preclude transition of door 210 from closed position 211 to open position 211A because power cord 20 may be disposed within opening 212 due to the operative engagement of power cord 20 with power connection 230. Thus, in such an embodiment, operative engagement of power cord 20 with projector 200 may have the effect of locking or securing door 210 in closed position 211. In these embodiments, prior to opening access door 210, it may be necessary to disconnect power cord 20 from projector 200 such that power cord 20 is no longer disposed within opening 212 of door 210 and no longer operatively engaged with power connection 230. Thus, it may not be possible to open access door 210 prior to removing power input from projector 200.

As will be discussed in accordance with FIGS. 5–7, a further embodiment of the electrical component safety apparatus 13 of the present disclosure is shown as being incorporated into projector 300.

Figure 5:
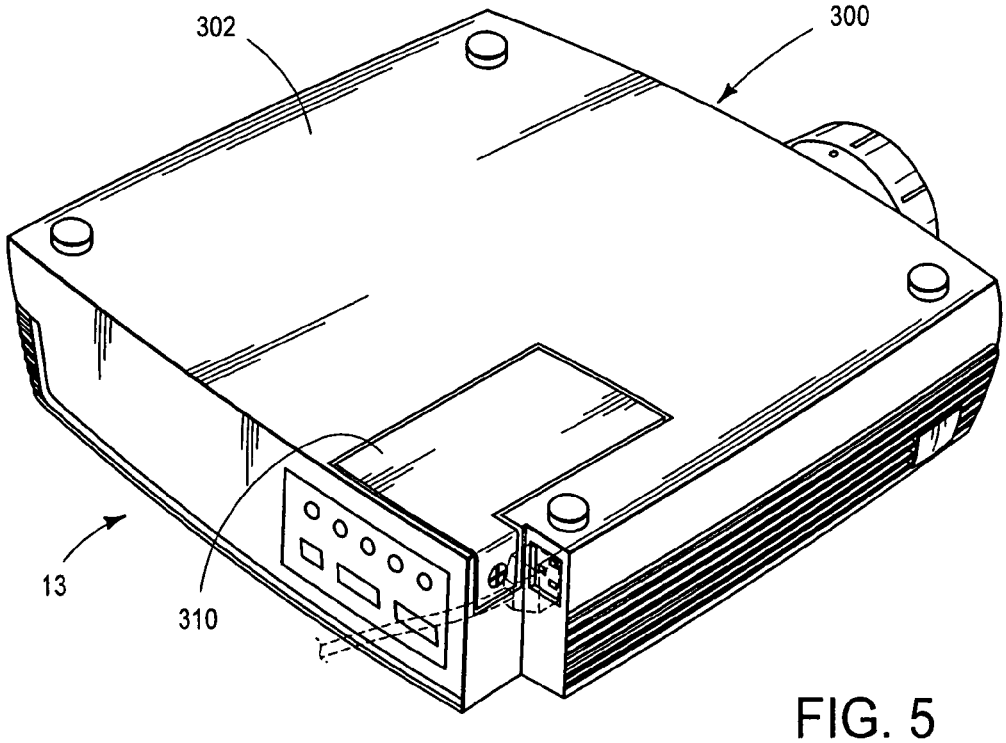
FIG. 5 is a perspective view of the bottom of an exemplary projection device incorporating a further embodiment of an electrical component safety apparatus of the present disclosure.

As illustrated in FIG. 5, projector 300 may include a housing 302 and an access door 310 disposed on the housing. Access door 310 may take various forms, such as a removable access panel, a hinged access door or panel, or a lamp door. Further, access door 310 may be disposed on any surface or combination of surfaces of housing 302. In projector 300, access door 310 may be used to provide access to electrical or electronic components, such as a lamp, light source, and/or image generation device, disposed within the interior of an electrical or electronic device. In some embodiments, access door 310 may be used to restrict access to controls disposed within housing 302. Further, in some embodiments, access door 310 may also include an electrical component such that access door 310 and an electrical component may form a modular unit permitting easy access or removal for tasks that may include inspection, maintenance, or replacement.

Figure 6A:
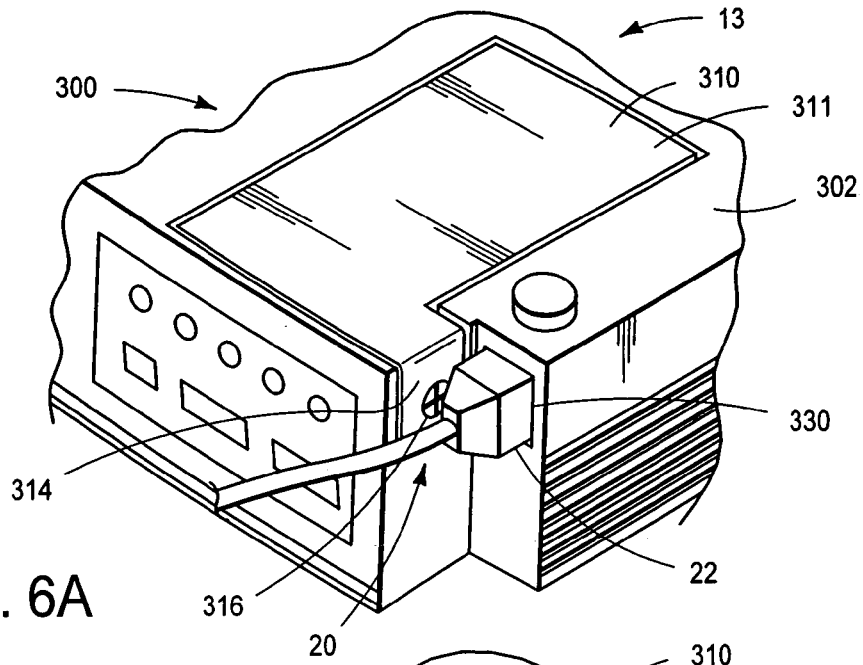
FIG. 6A is a fragmentary perspective view of the embodiment of FIG. 5 showing a power cord operatively engaged with the projection device.

As illustrated in FIG. 6A, projector 300 may also include a removable power cord 20 having a connector such as plug 22 at one end. An opposite end of power cord 20 may be connected to some external power supply such as a transformer, battery, or an AC wall socket. Power cord 20 may be connected to projector 300 by operatively engaging a portion of power cord 20, such as plug 22, with a power connection 330, which may be disposed on or within housing 302. Operative engagement between power cord 20 and power connection 330 may exist when power is capable of passing from power cord 20 to projector 300 through power connection 330. In some embodiments, power connection 330 may be a power inlet socket configured to receive plug 22. Power connection 330 and plug 22 may each be one of a corresponding pair of male and female type connectors. In other embodiments, power connection 330 and plug 22 may be other types of connectors, so long as the selected power connection 330 and plug 22 are both mutually configured to support an operative engagement between them.

In some embodiments, door 310 may include an arm 314 extending therefrom. Arm 314 may extend from an edge of door 310 as shown in FIG. 6A and may additionally include one or more bends such that at least a portion of arm 314 may either be not coplanar with or not parallel to at least a portion of door 310.

Figure 6B:
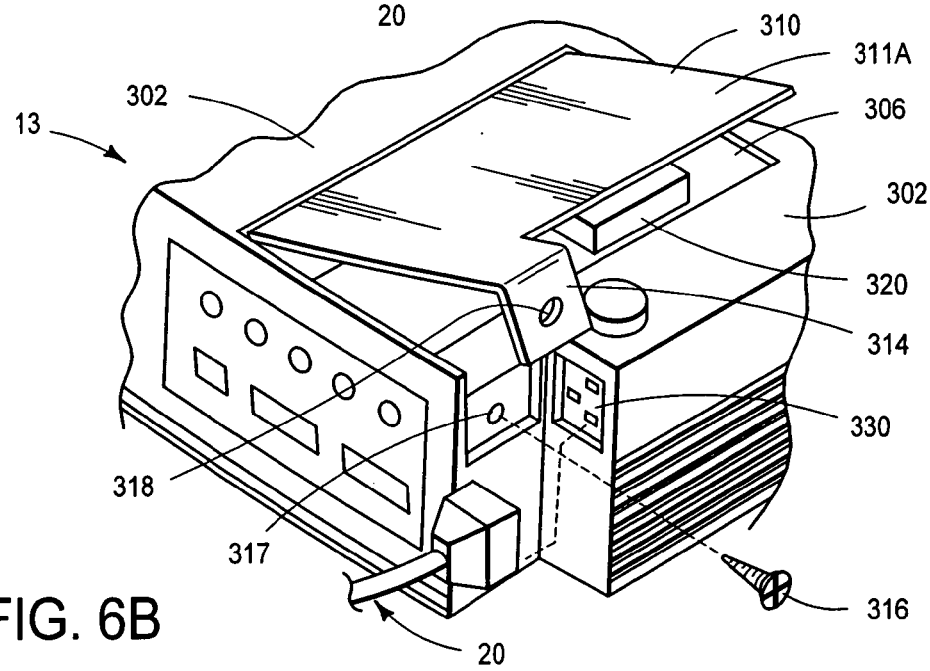
FIG. 6B is a fragmentary perspective view of the embodiment of FIG. 5 showing the lamp door in an open position and the power cord disconnected.

In some embodiments of projector 300, access door 310 may be secured in a closed position 311 by way of a fastener. The fastener may be a threaded fastener such as screw 316, as illustrated in FIGS. 6A–6B. In some embodiments, door 310 may be secured by various other or additional types of fasteners such as a magnetic or mechanical latch. A mechanical latch may comprise devices such as a sprung latch, a rotationally or linearly actuated latch, and/or a cam based latch. When door 310 includes both arm 314 and a fastener, the fastener may be at least partially disposed on arm 314.

FIG. 6B illustrates projector 300 with access door 310 positioned in open position 311A, where open position 311A may be understood to include any and all positions of door 310 other than closed position 311. Door 310 may pivot from closed position 311 to open position 311A as when door 310 is hingedly coupled to housing 302. However, in some embodiments, door 310 may transition from closed position 311 to some open position in other manners such as vertical, rotational, and/or horizontal translation.

Access door 310 may provide access to an electrical or electronic component within housing 302, such as a light source or projector lamp 320, in which case access door 310 may be considered a "lamp door." When access door 310 is in open position 311A, a user may access projector lamp 320 through access opening 306. In some embodiments, access door 310 may permit access to various types of electrical or electronic components and/or controls that may be disposed within housing 302.

As illustrated in FIG. 6B, some embodiments of projector 300 may secure access door 310 in closed position 311 by use of a rotationally actuated fastener such as screw 316. In these embodiments, projector 300 may be configured such that housing 302 includes a hole 317 that will be aligned with a corresponding through-hole 318 in access door 310 when access door 310 is in closed position 311. Door 310 may then be secured in closed position 311 by inserting screw 316 through hole 318 such that the threads of screw 316 may engage corresponding threads within hole 317. In embodiments where door 310 includes arm 314, hole 318 may be optionally on door 310 or arm 314. In some embodiments of projector 300 utilizing a rotationally actuated fastener such as screw 316, the fastener may be semi-permanently attached to door 310 as in the form of a captive fastener, or the fastener may be wholly unsecured to door 310.

In some embodiments, projector 300 may be configured such that a portion of door 310, such as arm 314, may preclude operative engagement of power cord 20 with power connection 330 unless door 310 is fully in closed position 311. Such a result may be achieved by configuring door 310 such that transitioning door 310 from closed position 311 to open position 311A may require that at least a portion of door 310 or arm 314 traverse through the space that would be occupied by at least a portion of power cord 20 if power cord 20 were operatively engaged with power connection 330. Thus, in these embodiments, it may be necessary to transition access door 310 to fully closed position 311 prior to operatively engaging power cord 20 with power connection 330.

In some embodiments, power cord 20 may be configured such that, while operatively engaged, a portion of power cord 20 prevents transitioning door 310 from closed position 311 to any open position 311A, effectively locking door 310 into closed position 311. Such a locking effect may be achieved by disposing power connection 330 sufficiently proximate to access opening 306 and configuring plug 22 such that at least a portion of plug 22 overlaps door 310 while plug 22 is operatively engaged with power connection 330. A portion of plug 22 may overlap door 310 when it sufficiently impedes transitioning door 310 from closed position 311 to any open position 311A.

In some embodiments of projector 300, projector 300 may include an interlock configured such that projector lamp 320 or other electrical or electronic components contained within housing 302 may be rendered inoperable when access door 310 is not fully in closed position 311. Exemplary interlocks include, but are not limited to, those discussed above for projector 100.

Figure 7:
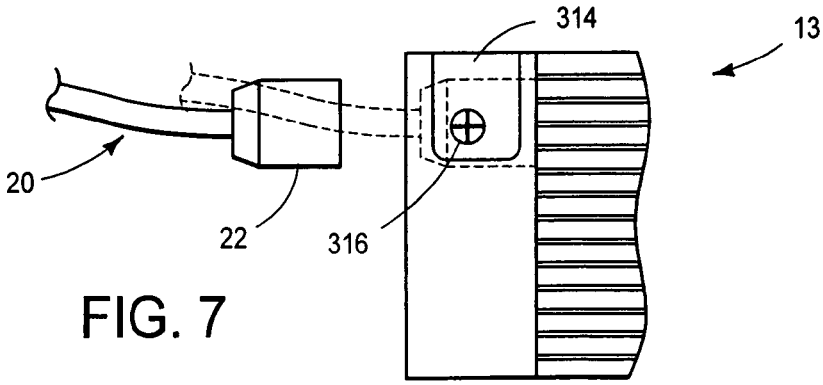
FIG. 7 is a side elevation view of the embodiment of FIG. 5 showing the power cord in connected and disconnected positions.

As illustrated in FIG. 7, access to the fastener securing door 310 in closed position 311 may be at least partially occluded in some embodiments by some portion of power cord 20, such as plug 22, when cord 20 is operatively engaged with projector 300. In embodiments where the fastener is screw 316, plug 22 may preclude the necessary tool access and/or removal clearance needed to disengage screw 316 while plug 22 is operatively engaged with power connection 330. In some embodiments, access to the interior of housing 302 may be effectively prevented because plug 22 may sufficiently obscure the fastener or fastener disengaging device while plug 22 is operatively engaged with power connection 330 so as to prevent the removal and/or disengagement of the fastener that would be necessary to transition door 310 from closed position 311 to open position 311A.

Although the present exemplary embodiments illustrate the use of an electrical component safety apparatus with a projector, it should be appreciated that the electrical component safety apparatus may be used in or with any suitable electrical or electronic device. For example, the electrical component safety apparatus may be used in other electrical or electronic devices, such as televisions, display monitors, radios, speakers, robots, vacuums, etc.

Although the present disclosure includes specific embodiments, specific embodiments are not to be considered in a limiting sense, because numerous variations are possible. The foregoing embodiments are illustrative, and no single feature, component, or action is essential to all possible combinations that may be claimed in this or later applications. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "a" or "a first" element or the equivalent thereof. Such claims should be understood to include incorporation of one or more such elements, neither requiring, nor excluding two or more such elements. Further, ordinal numbers, such as first, second, and third, for identified elements or actions are used to distinguish between the elements and actions, and do not indicate a required or limited number of such elements or actions, nor does it indicate a particular position or order of such elements or actions unless otherwise specifically stated. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. An electrical device having an electrical component safety apparatus, the device comprising:

a power cord;

a power connection configured to operatively engage the power cord; and an access door providing access to an electrical component having a closed position and an open position, wherein the door is configured such that the door is prevented from transitioning between the closed position and the open position while the power cord is operatively engaged with the power connection.

2. The electrical component safety apparatus of claim 1, wherein the access door further comprises an access door arm extending therefrom.

3. The electrical component safety apparatus of claim 2, wherein the arm further comprises an aperture.

4. The electrical component safety apparatus of claim 3, wherein the arm is configured such that the power cord passes through the aperture when the power cord is operatively engaged with the power connection.

5. The electrical component safety apparatus of claim 2, wherein the arm is configured for insertion into an opening on a housing when the access door is transitioned from the open position to the closed position.

6. The electrical component safety apparatus of claim 2, wherein at least a portion of the arm is not coplanar with at least a portion of the door.

7. The electrical component safety apparatus of claim 6, wherein at least a portion of the arm is not parallel to at least a portion of the door.

8. The electrical component safety apparatus of claim 6, wherein at least a portion of the arm is substantially perpendicular to at least a portion of the door.

9. The electrical component safety apparatus of claim 1, wherein the access door further comprises a fastener, wherein the fastener is configured to secure the access door in the closed position.

10. The electrical component safety apparatus of claim 9, wherein the fastener is a screw.

11. The electrical component safety apparatus of claim 9, wherein the fastener is a latch.

12. The electrical component safety apparatus of claim 9, wherein operational engagement of the power cord with the power connection prevents access to the fastener.

13. The electrical component safety apparatus of claim 1, wherein the access door further comprises an electrical component.

14. The electrical component safety apparatus of claim 1, wherein the power connection comprises a power inlet socket configured to receive the power cord.

15. The electrical component safety apparatus of claim 1, wherein the door further comprises an opening configured such that the power cord will be at least partially disposed within the opening when the door is in a closed position and the power cord is operatively engaged with the power connection.

16. A projector comprising:

a housing;

a light source disposed within the housing configured to generate and project an image onto a surface;

a power socket disposed on the housing;

a power cord configured for operative engagement with the power socket; and an access panel disposed on the housing, wherein the access panel is configured such that operative engagement of the power cord with the power socket secures the access panel in a closed position.

17. The projector of claim 16, wherein the access panel further comprises an opening wherein the power cord is at least partially disposed within the opening when the power cord is operatively engaged with the power socket.

18. The projector of claim 17, wherein the opening is an aperture.

19. The projector of claim 16, wherein the access panel further comprises a fastener configured to secure the access panel in the closed position, wherein the access panel is configured such that operative engagement of the power cord with the power socket prevents disengagement of the fastener.

20. The projector of claim 19, wherein the fastener is a screw.

21. The projector of claim 19, wherein the fastener is a latch.

22. The projector of claim 16, wherein the access panel comprises a lamp door configured to provide access to the light source.

23. The projector of claim 16, wherein the access panel is configured such that the power cord must be disconnected from the projector to open the access panel.

24. The projector of claim 23, wherein the projector is further configured such that the light source will be inoperable when the access panel is not in the closed position.

25. An electrical device having an electrical component safety apparatus, the device comprising:

a power cord;

a power connection configured to operatively engage the power cord; and an access door providing access to an electrical component having a closed position and an open position, wherein the door is configured such that the door is prevented from transitioning between the closed position and the open position while the power cord is operatively engaged with the power connection, wherein the access door further comprises an access door arm extending therefrom, wherein the access door arm comprises an aperture, and wherein the arm is configured such that the aperture will be operatively aligned with the power connection when the access door is in the closed position.

26. An electrical device having an electrical component safety apparatus, the device comprising:

a power cord;

a power connection configured to operatively engage the power cord; and an access door providing access to an electrical component having a closed position and an open position, wherein the door is configured such that the door is prevented from transitioning between the closed position and the open position while the power cord is operatively engaged with the power connection;

wherein the power cord comprises a connector configured to be received by the power connection, wherein the power connection is located at least partially proximate to the access door, and wherein the connector is configured such that when the power cord is operatively engaged with the power connection at least a portion of the connector overlaps at least a portion of the access door.

* * * * *